United States Patent [19]

Balarzs

[11] Patent Number: 4,910,855

[45] Date of Patent: Mar. 27, 1990

[54] WEIGHTED BALE BLANKET AND METHOD FOR USING THE SAME

[75] Inventor: Roger S. Balarzs, Narrows, Va.

[73] Assignee: Hoechst Celanese Corporation, Somerville, N.J.

[21] Appl. No.: 332,680

[22] Filed: Mar. 31, 1989

[51] Int. Cl.[4] ..... B23P 19/04

[52] U.S. Cl. ..... 29/426.4; 83/909; 83/DIG. 1; 414/412

[58] Field of Search ..... 5/417, 418, 419, 420, 5/482; 29/426.4, 564.3; 53/381 R; 83/909, DIG. 1; 100/298, 299; 414/24.5, 412, 786

[56] References Cited

U.S. PATENT DOCUMENTS

| | | | |
|---|---|---|---|
| 3,949,890 | 4/1976 | Keller | 414/412 X |
| 4,348,801 | 9/1982 | Dumont et al. | 29/564.3 |
| 4,437,223 | 3/1984 | Petros | 29/564.3 |
| 4,634,618 | 1/1987 | Greer et al. | 5/417 X |
| 4,709,430 | 12/1987 | Nicoll | 5/417 |
| 4,783,892 | 11/1988 | Hergeth | 29/426.4 |

*Primary Examiner*—Joseph M. Gorski
*Assistant Examiner*—Andrew E. Rawlins
*Attorney, Agent, or Firm*—Robert H. Hammer, III

[57] ABSTRACT

A blanket with a weighted perimeter and a method of its use are disclosed herein. This blanket is used as a safety device which can prevent injury to a person cutting baling straps, that surround baled materials and that are under tension, by dampening the whiplash of the straps when cut.

1 Claim, 1 Drawing Sheet

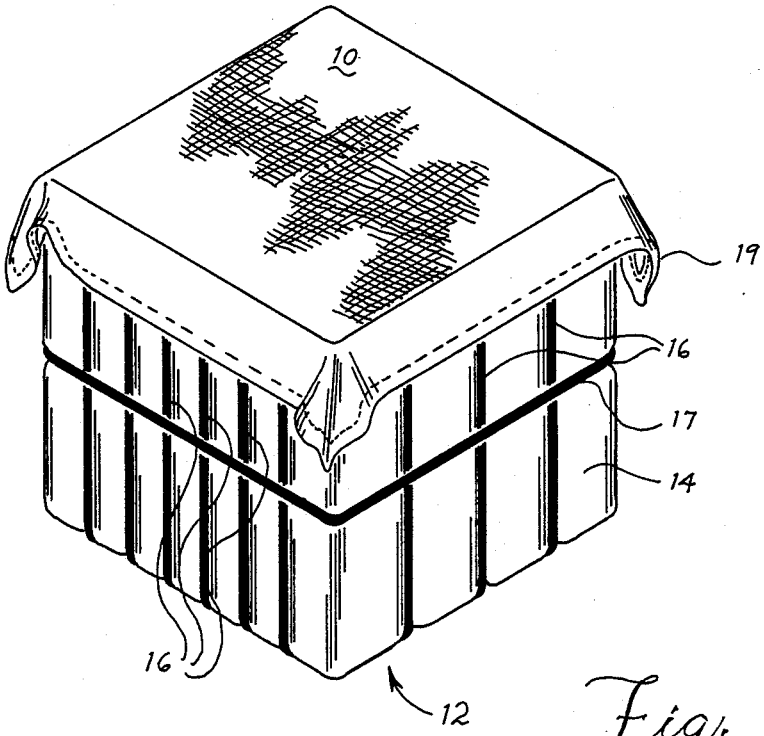
Fig. 1
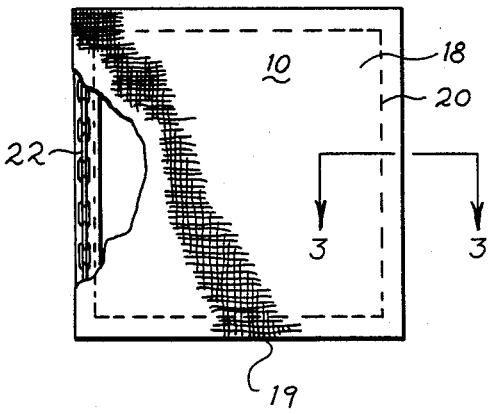
Fig. 2
Fig. 3
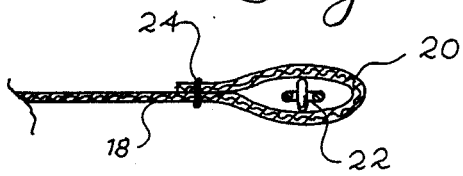

WEIGHTED BALE BLANKET AND METHOD FOR USING THE SAME

FIELD OF THE INVENTION

A blanket with a weighted perimeter and a method of its use are disclosed herein. This blanket is used as a safety device which can prevent injury to a person cutting baling straps, that surround baled materials and that are under tension, by dampening the whiplash of the straps when cut.

BACKGROUND OF THE INVENTION

Synthetic fibers, such as cellulose acetate for cigarette tow, as well as natural fibers, are sold in and delivered to customers in compressed bales. These bales are compacted in a press, at pressures up to about 90 tons. While the bale is compressed, metal straps are passed around the top and the bottom of the bale and about its girth to secure the material within the bale. For example, see U.S. Pat. No. 3,733,769 which is incorporated herein by reference. After the force of the press is released, the baled material wants to expand, but it is restrained by the baling straps. Therefore, the straps are put in tension due to the attempted expansion of the baled material.

When the straps are cut from the bale, to provide access to the material therein, they whiplash outwardly and upwardly from the bale. This is a safety hazard to those cutting the straps from the bale and to those in the immediate vicinity of the bale while the straps are cut. Accordingly, there is a need for a device that can dampen or eliminate this whiplash and thereby improve the safety of cutting baling straps from baled material.

SUMMARY OF THE INVENTION

A safety device that dampens the whiplash of tensioned baling straps surrounding a bale of material comprises means for blanketing a portion of the bale, and means for weighting the blanketing means evenly over said portion of the bale.

This safety device provides the following advantages: it is very reliable when used; it is easy to apply prior to cutting the baling straps; it is easy to remove once the baling straps have been cut; it requires little to no additional labor to use; it is easy to maintain because it is non-mechanical; and it is inexpensive to make.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric view of the blanket with a weighted perimeter in use on baled material.

FIG. 2 is a plan view of the blanket with a weighted perimeter, part broken away for clarity.

FIG. 3 is side elevational view taken generally along sectional lines 3—3 of FIG. 2

DETAILED DESCRIPTION OF THE INVENTION

Referring to the drawings, wherein like numerals indicate like elements, there is shown in FIG. 1 a blanket 10 having a weighted perimeter that covers a top portion of a bale 12 of material 14. Baled material 14 is held in the form of bale 12 by a plurality of baling straps 16 and 17. Baling straps 16 encircle bale 12 around its top and bottom and are under tension due to the attempted expansion of the baled material 14. Strap 17 surrounds the girth of bale 12. When straps 16 are cut, to release the contents of bale 12, they whiplash outwardly and upwardly over the bale, thereby releasing the tension thereon.

Blanket 10 is placed over the top portion of bale 12 prior to the cutting of straps 16. Blanket 10 is weighted, preferably about its periphery 19, so as to dampen the whiplash of straps 16, as discussed below. The weighted periphery allows the entire weight of the blanket 10 to be evenly distributed over the top portion of bale 12. The weight of the blanket dampens the whiplash of straps 16.

Referring to FIG. 2, blanket 10 preferably comprises a generally rectangular cloth 18 that has a hem 20 about its periphery 19. A chain 22 is sewn into the hem. The hem is fastened to the cloth 18 by stitching 24 (see FIG. 3).

Cloth 18 is preferably a 1000 denier corduroy nylon; however, other suitable materials may be used. Selection of those materials is such that its durability is of the utmost concern. Additionally, the edges of the cloth 18 should be finished so as to prevent the cloth from unraveling. The finished dimensions of the blanket 10 should be approximately 65 inches by 75 inches; however, any other suitable dimensions may be used so long as blanket 10 enshrouds the entire top portion of bale 12 (see FIG. 1).

Chain 22 is preferably a No. 3 twist link chain. Chain 22, shown in FIG. 2, completely encircles the entire periphery of blanket 10; however, chain 22 may be of longer or shorter lengths so long as the total weight of the finished blanket 10 can dampen the whiplash of straps 16. Preferably, the chain 22 is tacked within the hem every 15 inches to prevent the chain from bunching. The finished blanket 10 may have a weight ranging from 5 to 7 pounds, and it preferably has a weight of approximately 6½ to 7 pounds; however, the weight of the finished blanket is chosen so that it is sufficient to dampen the whiplash of straps 16.

In use, blanket 10 is placed over the top portion of bale 12 prior to the cutting of straps 16. With blanket 10 in place on the upper portion of bale 12, straps 16 may then be cut. The weighted blanket 10 dampens the whiplash of straps 16, thereby reducing the risk of injury to the person cutting the straps and those in the vicinity of the bale when the straps are cut. After straps 16 have been cut, blanket 10 is removed.

The present invention may be embodied in other specific forms without departing from the spirit or essential attributes thereof and, accordingly, reference should be made to the appended claims, rather than to the foregoing specification, as indicating the scope of the invention.

That which is claim is:

1. A method of removing tensioned baling straps from bales in a more safe manner, comprising the steps of:

providing a bale with a plurality of tensioned baling straps therearound;

providing a blanket;

placing said blanket weighted at least along its peripheral portion over a top portion of said bale;

cutting said baling straps, thereby causing the tension on said straps to be released by whiplash of said straps and the blanket dampening the whiplash; and removing said blanket.

* * * * *